US005221290A

United States Patent [19]

Dell

[11] Patent Number: 5,221,290

[45] Date of Patent: Jun. 22, 1993

[54] CHARCOAL BRIQUETTES BOUND WITH AN ORGANIC BINDER AND A WATER-SWELLABLE CLAY AND METHOD

[75] Inventor: Donald J. Dell, Spearfish, S. Dak.

[73] Assignee: American Colloid Company, Arlington Heights

[21] Appl. No.: 650,473

[22] Filed: Feb. 4, 1991

[51] Int. Cl.[5] ..... C10L 5/14

[52] U.S. Cl. ..... 44/554; 44/559; 44/560; 44/593; 44/594

[58] Field of Search ..... 44/593, 594, 554, 559, 44/560

[56] References Cited

U.S. PATENT DOCUMENTS

| | | | |
|---|---|---|---|
| 3,089,760 | 5/1963 | Jaffe | 44/628 |
| 3,304,161 | 2/1967 | McGoff | 44/558 |
| 3,385,681 | 5/1968 | Mennen | 44/558 |
| 3,485,600 | 12/1969 | Robertson | 44/572 |
| 3,689,234 | 9/1972 | Onozawa | 44/558 |
| 3,709,700 | 1/1973 | Ross | 44/603 |
| 4,167,398 | 9/1979 | Hughes et al. | 44/558 |
| 4,787,914 | 11/1988 | Crace | 44/559 |
| 4,981,494 | 1/1991 | Breuil et al. | 44/560 |
| 5,009,671 | 4/1991 | Franke et al. | 44/560 |

FOREIGN PATENT DOCUMENTS

| | | | |
|---|---|---|---|
| 5695 | of 1903 | United Kingdom | 44/559 |
| 24215 | of 1903 | United Kingdom | 44/560 |
| 7829 | of 1913 | United Kingdom | 44/560 |
| 274876 | 4/1928 | United Kingdom | 44/559 |

*Primary Examiner*—Jerry Johnson

*Attorney, Agent, or Firm*—Marshall, O'Toole, Gerstein, Murray & Bicknell

[57] ABSTRACT

A combustible carbonaceous briquette and method of making the briquette wherein a finely divided carbonaceous material is formed into a desired briquette shape under high pressure whereby carbonaceous particles are bound together by a pre-cooked mixture of an organic binder and a water-swellable clay. The combustible carbonaceous material is present in the briquette composition in an amount of about 85% to about 96% by weight; the organic binder is present in an amount of about 2% to about 8% by weight; and the water-swellable clay is present in an amount of about 1% to about 5% by weight. The weight ratio of organic binder to water-swellable clay, dry weight basis, is in the range of from about 1.5 to about 3.0 to 1.

25 Claims, 1 Drawing Sheet

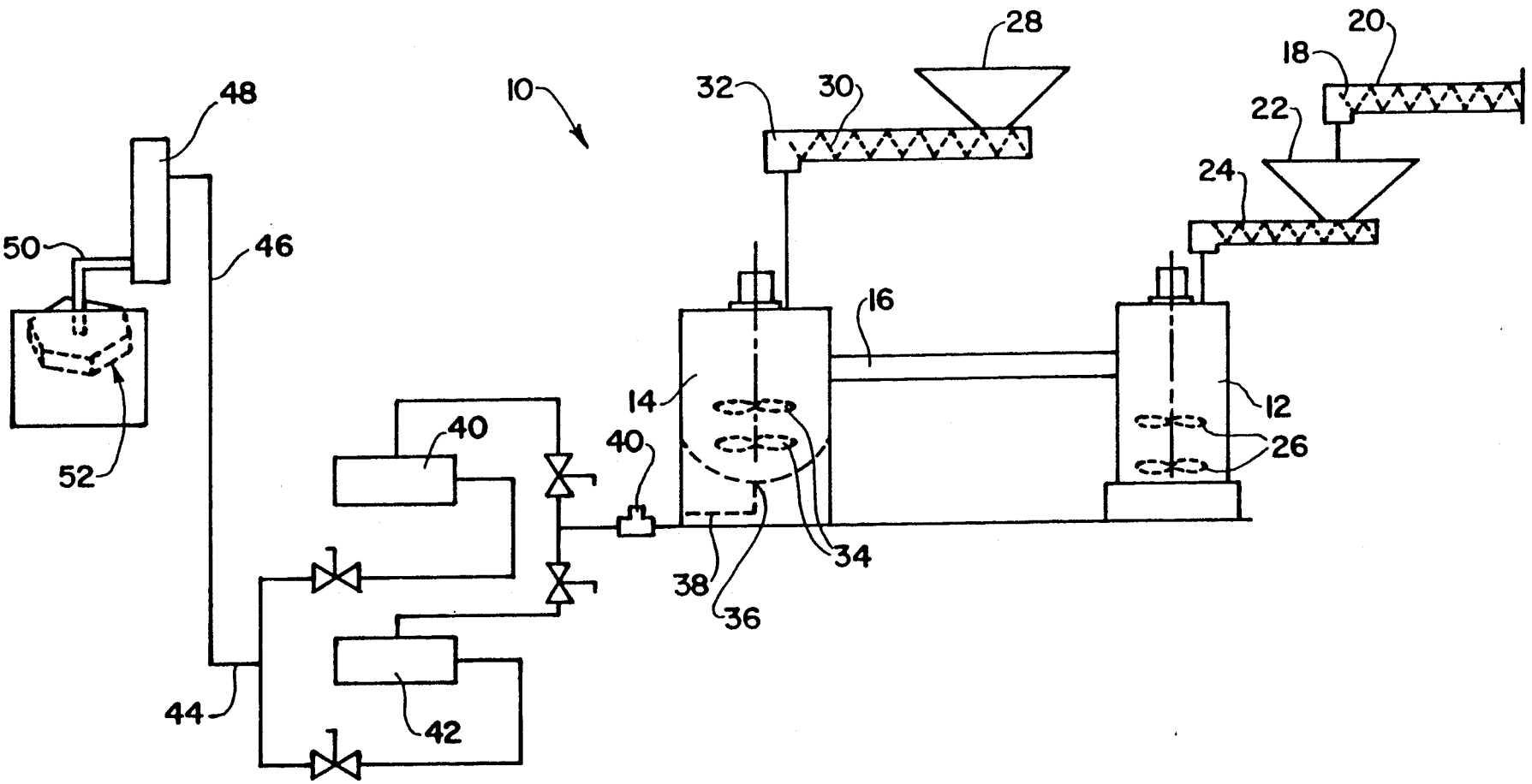
10
12
14
16
18
20
22
24
26
28
30
32
34
36
38
40
40
42
44
46
48
50
52

CHARCOAL BRIQUETTES BOUND WITH AN ORGANIC BINDER AND A WATER-SWELLABLE CLAY AND METHOD

FIELD OF THE INVENTION

The present invention is directed to a briquette made from one or more combustible carbonaceous materials together with an organic binder, particularly a starch or starch derivative, and a water-swellable clay, such as bentonite. The briquette is made, in accordance with the present invention, by forming a slurry of the organic binder and water-swellable clay to hydrate the clay and provide intimate contact of the hydrated clay with the organic binder prior to combining the organic binder/-clay mixture with the combustible carbonaceous material in order to substantially increase the binding capacity of the organic binder while reducing the amount of organic binder. The composition containing the combustible carbonaceous material; organic binder; and clay then is dried to a desired moisture content and compressed under high pressure into a desired briquette shape, as known in the art.

BACKGROUND OF THE INVENTION AND PRIOR ART

Charcoal briquettes are commonly used in the United States as a source of heat and flavor for outdoor cooking on a barbecue grill or hibachi. The charcoal briquettes are formed from a combination of a combustible carbonaceous material such as charcoal, pete, coal, or other combustible carbon sources together with a binder, such as corn starch, a non-toxic polymeric material and the like, compressed under high pressure into briquettes for use as a barbecue fuel. After the composition is formed into a briquette, the briquettes are dried to remove essentially all of the moisture so that the briquettes are capable of ignition. Exemplary of various charcoal briquette compositions and methods of manufacturing charcoal briquettes include the following U.S. Pat. Nos.: Spencer, 1,590,706; Wagel, 1,618,029; Jaffe, 3,089,760; McGoff, 3,304,161; Ross, 3,709,700; Robertson, 3,485,600; Mennen, 3,385,681; Onozawa, 3,689,234; Swinehart, et al 2,822,251; Hughes, et al 4,167,398; and, Crace, 4,787,914.

Many charcoal briquettes presently are manufactured using corn starch as the sole binder for maintaining the briquette in the form of a cohesive mass having sufficient green strength and dry strength so that the briquette does not break into pieces during normal transportation, storage and handling. While others have attempted to eliminate some of the corn starch binder by replacing this binder with other additives, in order to increase the binding strength or to reduce the cost of manufacturing the charcoal briquettes, these attempts, in the past, have not met with much success because of the inability of the binder combination to provide adequate green strength and dry strength to the finished charcoal briquettes and the inability of such binder combinations to provide a smooth briquette surface which, in the consumer's eye, is an indication of quality.

These disadvantages have been overcome in accordance with the principals of the present invention by providing a binder mixture for a combustible carbonaceous material in the formation of a charcoal briquette that includes an organic binder together with a water-swellable clay, in a weight ratio of about 1.5 to about 3.0 parts by weight organic binder to 1 part by weight water-swellable clay, and forming a water slurry of the organic binder and the water-swellable clay to achieve tenacious physical and/or chemical bonding between the water-swellable clay and the organic binder prior to mixing the binder composition with the combustible carbonaceous material.

SUMMARY OF THE INVENTION

In brief, the present invention is directed to a combustible carbonaceous briquette and method of making the briquette wherein a finely divided carbonaceous material is formed into a desired briquette shape under high pressure whereby carbonaceous particles are bound together by a pre-cooked mixture of an organic binder and a water-swellable clay. The combustible carbonaceous material is present in the briquette composition of the present invention in an amount of about 85% to about 96% by weight; the organic binder is present in an amount of about 2% to about 8% by weight; and the water-swellable clay is present in an amount of about 1% to about 5% by weight. To achieve the full advantage of the present invention, the weight ratio of organic binder to water-swellable clay, dry weight basis, is in the range of from about 1.5 to about 3.0 to 1.

Accordingly, one aspect of the present invention is to provide a combustible briquette from a combustible carbonaceous material, an organic binder, and a water-swellable clay that achieves tenaceous bonding of the particles of carbonaceous material with a lower percentage of organic binder.

Another aspect of the present invention is to provide a combustible briquette and method of manufacturing the briquette by pre-reacting a hydroxyl group-reactive organic binder with a water-swellable clay in its hydrated state to improve the binding capacity of the organic binder at lower percentages in binding carbonaceous particles of the combustible briquette.

BRIEF DESCRIPTION OF THE DRAWING

The above and other aspects and advantages of the present invention will become more apparent from the following detailed description of the preferred embodiments, taken in conjunction with the drawing which is a schematic diagram of an apparatus and method for manufacturing the combustible briquettes of the present invention.

DETAILED DESCRIPTION OF THE PREFERRED EMBODIMENTS

The combustible carbonaceous briquette of the present invention includes about 85% to about 96% by weight of a suitable combustible carbonaceous material such as powdered charcoal, powdered anthracite coal or powdered coke that is sufficiently finely divided to be compressed together under high pressure of about 10,000 to about 20,000 psi together with a binder to form a cohesive mass in a desired briquette shape having sufficient dry strength for handling and transportation without significant breakage, e.g. less than 10% of the briquettes being broken in normal handling and transportation. To achieve the full advantage of the present invention, at least about 90% of the carbonaceous particles should have a dimension of about 44 microns or less and preferably at least 95% by weight of the carbonaceous particles are less than or equal to about 44 microns in any one dimension.

In accordance with an important feature of the present invention, the combustible carbonaceous particles are bound together with a pre-cooked hydrated organic binder/water-swellable clay paste that, unexpectedly, achieves approximately equal dry strength in the finished briquette, as the same briquette without the water-swellable clay and with a higher percentage of organic binder. Further, unexpectedly, the pre-cooked paste used to bind the combustible carbonaceous particles under high pressure achieves a much smoother briquette surface finish than the use of an organic binder alone, and the formed briquettes are, therefore, much more uniform in size and shape, have a higher quality appearance and are more appealing to the eye of the consumer.

The water swellable clays used in the compositions and methods of the present invention include reactive hydroxyl groups that are more available for reaction with a hydroxyl-reactive substituent of organic binders when the clay is in the hydrated state. Accordingly, the organic binders useful in the compositions and methods of the present invention include any organic binder that is at least partially soluble in water (at least 10% by weight solubility at one atmosphere pressure and 25° C.). A wide range of organic binders that are soluble in water and include a substituant reactive with the water-swellable clay hydroxyl groups include all of the starches, such as corn starch, wheat starch, barley starch, sorghum starch, sago palm starch, tapioca starch, potato starch, rice starch, and arrowroot starch, each including reactive hydroxyl groups; hydroxy alkyl celluloses, such as hydroxy methyl cellulose, hydroxy propyl cellulose, hydroxy propyl methyl cellulose, hydroxy ethyl cellulose, hydroxy propyl ethyl cellulose; the carboxy alkyl celluloses, such as carboxy methyl cellulose, carboxy ethyl cellulose, carboxy propyl methyl cellulose, and the like, each including reactive carboxyl groups; the polysaccharides, such as dextrin, dextrose, glucose, lactose, maltose, sucrose and the like; the hydroxyl-reactive gums such as gum arabic, gum tragacanthe, guar gum, gum karaga, locust bean gum, okra gum, and the like; and any other hydroxyl-reactive organic adhesive materials that are non-toxic when pyrolyzed.

The organic binder and the water-swellable clay are slurried in water to a total solid content in the slurry in the range of about 10% to about 50% by weight, dry solids basis, with a weight ratio of organic binder to water-swellable clay in the range of about 1.5 to about 3.0 to 1.

Turning now to the drawing, there is shown an apparatus and method for reacting an organic binder with a water-swellable clay to form a binder composition, in paste form, capable of achieving excellent green strength and dry compressive strength for charcoal briquettes with a lower organic binder content. As shown in the drawing, the apparatus, generally designated 10, includes a binder/clay premix tank 12 and an organic binder clay slurry tank 14 in fluid communication via conduit 16. A water-swellable clay-reactive organic binder, such as corn starch, is fed through feed shoot 18 by auger 20 and is received in organic binder hopper 22 and conveyed by auger 24 to the organic binder premix tank 12. The organic binder is mixed with water in the premix tank 12 by impeller blades 26 and, after sufficient mixing, is conveyed through conduit 16 to the organic binder/clay slurry tank 14.

A water-swellable clay is initially fed into clay hopper 28 and is conveyed by auger 30 in clay feed shoot 32 to the organic binder/clay slurry tank 14 where the clay and organic binder are throughly mixed by impellers 34. In the slurry tank 14, the organic binder and clay are heated under pressure sufficient to keep the water in the slurry from boiling, e.g., from about 1 atmosphere pressure to about 200 psig and to a temperature sufficient to react the organic binder with one or more of the hydroxyl groups on the hydrated clay. Suitable temperatures are, for example, about 80° C. to about 120° C. The resulting binder composition is in the form of a paste. The organic binder/clay slurry tank 14 is continued to be heated until the viscosity of the paste is in the range of about 1,000 centipoises to about 10,000 centipoises, preferably in the range of about 1,000 centipoises to about 5,000 centipoises. The finished paste exits the organic binder/clay slurry tank 14 at the bottom through exit slurry tank outlet 36 and is conveyed along conduit 38 through a strainer 40, for removing solid agglomerates and is pumped by one of two alternate pumps 40 or 42, each capable of pumping viscous materials, through conduits 44 and 46 to a pressure cooker 48. In pressure cooker 48, the organic binder and clay are heated at a pressure sufficient to prevent water from boiling, e.g. about 1 atmosphere pressure to about 200 psig and at a temperature of at least about 80° C., preferably about 90° C. to about 120° C. to increase the solids content of the organic binder/clay mixture to a level of at least about 55% by weight solids and preferably in the range of about 60% to about 75% by weight solids. From the cooker 48, the paste is fed via conduit 50 to a briquette press, generally designated by reference numeral 52, for compressing the organic binder/clay reaction product together with combustible carbonaceous material, in finely divided form, to form the composition into a briquette having unexpectedly high strength for the inclusion of a relatively small amount of organic binder and having an exceptionally smooth and attractive appearance.

The water-swellable clays that are useful for reaction with hydroxyl-reactive organic binders for use in the charcoal briquettes and methods of the present invention include any water-swellable clay that will hydrate in the presence of water, i.e., will swell in the presence of water. In accordance with one important embodiment of the present invention, the water-swellable clay is bentonite. A preferred bentonite is sodium bentonite which is basically a hydratable montmorillonite clay of the type generally found in the Black Hills region of South Dakota and Wyoming. This clay has sodium as a predominant exchange ion. However, the bentonite utilized in accordance with this embodiment of the present invention may also contain other cations such as magnesium and iron. There are cases wherein a montmorillonite predominant in calcium ions can be converted to a high swelling sodium variety through a well known process called "peptizing". The colloidal clay utilized in this invention may be one or more peptized bentonites. The colloidal clay may also be any member of the diocthaedral or trioctahedral smecite group or mixtures thereof. Examples are Beidellite, Nontronite, Hectorite, Sepiolite and Saponite. Attapulgite and Kaolin clay also may be bound to a hydroxyl-reactive organic binder for use in binding conbustible carbonaceous materials in accordance with the present invention. To achieve the full advantages of the present invention, the water-swellable clay, i.e. bentonite, generally is finely divided or ground as known for use in water barrier panels and the like, i.e., 20 to 350 mesh, preferably 20 to 50 mesh.

It should be understood that the present disclosure has been made only by way of preferred embodiments and that numerous changes in details or construction, combination and arrangement of parts can be resorted to without departing from the spirit and scope of the invention as hereunder claimed.

What is claimed is:

1. A combustible carbonaceous briquette comprising a finely divided material in an amount of about 85% to about 96% by weight; a hydroxyl-reactive organic binder in an amount of about 2% to about 8% by weight; and a water-swellable smectite clay reacted with the organic binder in a hydrated state in an amount of about 1% to about 5% by weight, wherein the weight ratio of organic binder to water-swellable clay, dry weight basis, is in the range of from about 1.5 to about 3.0 to 1.

2. The composition of claim 1 wherein the weight ratio of organic binder to water-swellable clay is in the range of from about 2.0 to about 2.5 to 1.

3. The composition of claim 2 wherein the weight ratio of organic binder to water-swellable clay is in the range of about 7 to 3.

4. The composition of claim 1 wherein the organic binder is selected from the group consisting of starch, a hydroxyl alkyl cellulose, dextrin, a gum, polyvinyl alcohol, a carboxy alkyl cellulose, metal salts of a carboxy alkyl cellulose, and a polysaccharide.

5. The composition of claim 4 wherein the organic binder is a starch selected from the group consisting of corn starch, wheat starch, barley starch, sorghum starch, sago palm starch, tapioca starch, potato starch, rice starch, arrowroot starch, and mixtures thereof.

6. The composition of claim 4 wherein the organic binder is a gum selected from the group consisting of gum arabic; gum tragacanthe; guar gum; gum karaga; locust bean gum; agar; okra gum; and mixtures thereof.

7. The composition of claim 1 wherein the clay is a dioctahedral smectite, a trioctrahedral smectite, or a mixture thereof.

8. The composition of claim 7 wherein the clay is selected from the group consisting of montmorillonite, beidellite, nontronite, hectorite, saponite, and mixtures thereof.

9. The composition of claim 8 wherein the water-swellable clay is a montmorillonite clay.

10. The composition of claim 9 wherein the clay is a bentonite clay selected from the group consisting of sodium bentonite, potassium bentonite, lithium bentonite, ammonium bentonite, clacium bentonite, magnesuim bentonite and mixtures thereof.

11. The composition of claim 11 wherein the clay is sodium bentonite.

12. A method of manufacturing a combustible carbonaceous briquette comprising:

adding a hydroxyl-reactive organic binder and a water-swellable smectite clay to water to form a hydrated clay/organic binder slurry, wherein the weight ratio of organic binder to water-swellable clay is in the range of about 1.5 to about 3.0 to 1;

heating the hydrated clay/organic binder slurry to increase the solids content of the slurry to at least about 55% by weight solids, to form a bond between the organic binder and the hydrated clay to form a binder paste;

mixing the binder paste in contact with particles of a combustible carbonaceous material in an amount of about 2% to about 8% by weight paste, dry weight basis to form a briquette composition; and compressing the briquette composition under pressure sufficient to for a briquette having sufficient dry strength for handling and transport without substantial breakage.

13. The method of claim 12 wherein the organic binder/clay is heated to a viscosity in the range of about 1,000 cps to about 10,000 cps before contacting the combustible carbonaceous material with said paste.

14. The method of claim 13 wherein the organic binder/clay is heated to a viscosity of about 1,000 cps to about 5,000 cps to form the paste before contacting the combustible carbonaceous material with said paste.

15. The method of claim 12 wherein the paste/-briquette composition is compressed at a pressure of about 10,000 psi to about 20,000 psi to form the briquette.

16. The method of claim 12 wherein the weight ratio of organic binder water-swellable clay is in the range of from about 2.0 to about 2.5 to 1.

17. The method of claim 16 wherein the weight ratio of organic binder to water-swellable clay is in the range of about 7 to 3.

18. The method of claim 12 wherein the organic binder is selected from the group consisting of starch, a hydroxyl alkyl cellulose, dextrin, a gum, polyvinyl alcohol, a carboxy alkyl cellulose, metal salts of a carboxy alkyl cellulose, and a polysaccharide.

19. The method of claim 18 wherein the organic binder is a starch selected from the group consisting of corn starch, wheat starch, barley starch, sorghum starch, sago palm starch, tapioca starch, potato starch, rice starch, arrowroot starch, and mixtures thereof.

20. The method of claim 18 wherein the organic binder is a gum selected from the group consisting of gum arabic; gum tragacanthe; guar gum; gum karaga; locust bean gum; agar; okra gum; and mixtures thereof.

21. The method of claim 12 wherein the clay is a dioctachedral smectite, a trioctrahedral smectite, or a mixture thereof.

22. The method of claim 21 wherein the clay is selected from the group consisting of montmorillonite, beidellite, nontronite, hectroite, saponite, and mixtures thereof.

23. The method of claim 22 wherein the water-swellable clay is a montmorillonite clay.

24. The method of claim 23 wherein the clay is a bentonite clay selected from the group consisting of sodium bentonite, potassium bentonite, lithium bentonite, ammonium bentonite, clacium bentonite, magnesium bentonite, and mixtures thereof.

25. The method of claim 25 wherein the clay is sodium bentonite.

* * * * *